US006841014B2

(12) United States Patent
Huang et al.

(10) Patent No.: US 6,841,014 B2
(45) Date of Patent: Jan. 11, 2005

(54) METHOD FOR MANUFACTURING A STRIKING PLATE OF A GOLF CLUB HEAD

(75) Inventors: Chun-Yung Huang, Kaohsiung Hsien (TW); Chan-Tung Chen, Kaohsiung (TW)

(73) Assignee: Fu Sheng Industrial Co., Ltd., Taipei (TW)

( * ) Notice: Subject to any disclaimer, the term of this patent is extended or adjusted under 35 U.S.C. 154(b) by 146 days.

(21) Appl. No.: 10/379,699

(22) Filed: Mar. 6, 2003

(65) Prior Publication Data

US 2004/0144453 A1 Jul. 29, 2004

(51) Int. Cl.[7] ..... C21D 8/00

(52) U.S. Cl. ..... 148/608; 148/610; 148/648; 148/649; 148/651; 473/329

(58) Field of Search ..... 148/669–671, 148/648–651, 605, 579, 607–609; 473/329

(56) References Cited

U.S. PATENT DOCUMENTS

| | | | | |
|---|---|---|---|---|
| 5,282,624 A | * | 2/1994 | Viste | 473/342 |
| 6,672,975 B1 | * | 1/2004 | Galloway | 473/342 |
| 6,739,983 B2 | * | 5/2004 | Helmstetter et al. | 473/342 |
| 6,758,763 B2 | * | 7/2004 | Murphy et al. | 473/342 |
| 6,776,726 B2 | * | 8/2004 | Sano | 473/330 |

* cited by examiner

*Primary Examiner*—Deborah Yee
(74) *Attorney, Agent, or Firm*—Bacon & Thomas PLLC

(57) ABSTRACT

A method for manufacturing a striking plate of a golf club head includes the steps of soft heat-treating a flat metal blank to increase its malleability, stamping out a striking plate with an integral wall and a bend portion from the flat metal blank, precise machining the striking plate, and age hardening the striking plate to precipitation harden it and improve its mechanical properties after it has been joined to a main body of the golf club head.

12 Claims, 5 Drawing Sheets

METHOD FOR MANUFACTURING A STRIKING PLATE OF A GOLF CLUB HEAD

BACKGROUND OF THE INVENTION

1. Field of the Invention

The present invention relates to a method for manufacturing a striking plate of a golf club head and, more particularly, to a method for manufacturing a striking plate with an integral wall and a bend portion by a stamping process subsequent to a high-temperature soft heat treatment, followed by a optional finishing machining process and then an age hardening process that precipitation hardens the striking plate, in order to provide an improved strength, elastic resilience and manufacturing accuracy for the resulting striking plate.

2. Description of Related Art

As shown in FIG. 1, a golf club head typically includes a main body 10 having a front opening 101 and a sleeve 102, and a striking plate 20 jointed to the main body 10 and engaged with an inner stepped portion 103 which is formed immediately within the inner circumference of the opening 101. Moreover, the striking plate 20 is generally provided with a plurality of parallel grooves 201 to increase friction useful in hitting a golf ball.

From a structural mechanical viewpoint, such embedding or welding joint of the plate 20 to the main body 10 absorbs impact produced by the ball and thus allows to transmit incomplete reaction from the plate 20 to the ball just before elastic deformation in the plate 20 reaches its climax. Consequently, the striking plate 20 limits the golf club head for hitting a long distance and such structure is unsuitable for hitting long distance. Additionally, the striking plate 20 within the inner circumference of the opening 101 of the main body 10 provides only a limited effective area for hitting the ball.

FIG. 2 shows another golf club head that includes a main body 10 provided with a rim 12 defining a front opening 11 and a striking plate 20 provided with an integral wall 21 and a bend portion 22. In addition to the fact of maximizing the effective area for hitting the ball, the bend portion 22 also impedes the transmission of impact from the plate 20 to the body 10. This results in a maximum elastic deformation in the plate 10 as it hits the balls and, in turn, an improved coefficient of restitution (COR) that may enable the golf club head to hit the ball long distance.

However, the striking plate 20 here is made by precision casting, a process in which various defects, such as slag eyes, sand inclusions, contraction cavities and blowholes, readily occur. These defects aggravate mechanical properties of the cast striking plate 20, which, as a casting, is weaken at its bend portion 22.

OBJECTS OF THE INVENTION

An object of the present invention is to provide a method for manufacturing a striking plate of a golf club head by a stamping process in which the striking plate is provided with an integral wall and a bend portion both having increased mechanical properties due to the process, so as to provide an improved elastic resilience and strength for the resulting striking plate.

Another object of the present invention is to provide a method for manufacturing a striking plate of a golf club head in which the stamping process is conducted between a soft heat-treating process and an age hardening process, so as to provide an extremely improved strength for the resulting striking plate.

A still another object of the present invention is to provide a method for manufacturing a striking plate of a golf club head in which additional grooves, marks or variations in thickness and curvature may be formed synchronous in the striking plate during the stamping process.

SUMMARY OF THE INVENTION

To achieve the aforementioned objects, the present invention provides a method including the steps of soft heat-treating a flat metal blank to increase its malleability, stamping out a striking plate with an integral wall and a bend portion from the flat metal blank, precise machining the striking plate and, after it has been joined to a main body, age hardening the striking plate to precipitation harden it and improve its mechanical properties.

Other objects, advantages and novel features of this invention will become more apparent from the following detailed description when taken in conjunction with the accompanying drawings.

DETAILED DESCRIPTION OF THE PREFERRED EMBODIMENT

The present invention is now to be described hereinafter in detail by way of a preferred embodiment in reference to drawings.

Figure 3:
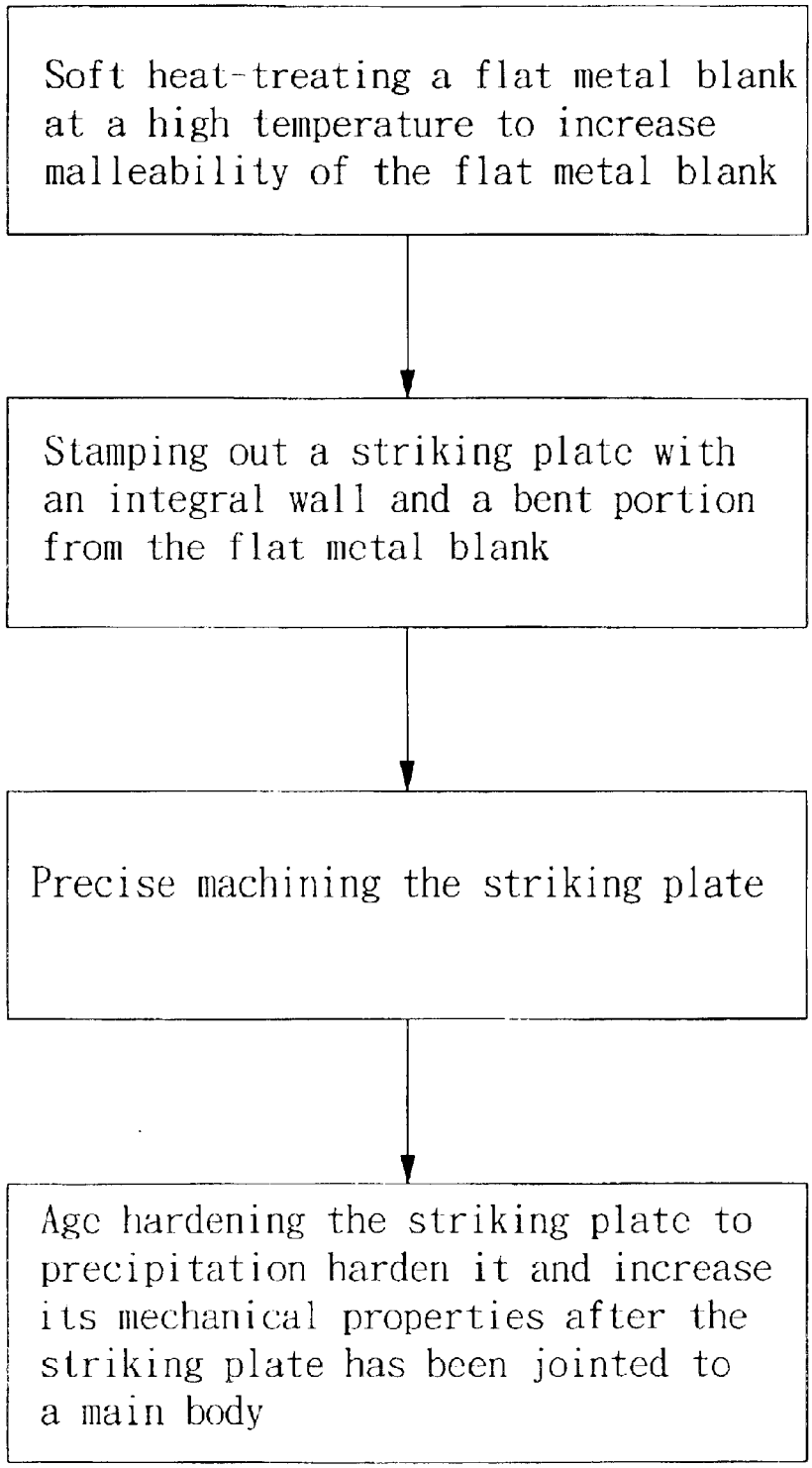
FIG. 3 is a flow diagram of a preferred embodiment of the method in accordance with the present invention for manufacturing a striking plate of a golf club head.
Figure 4:
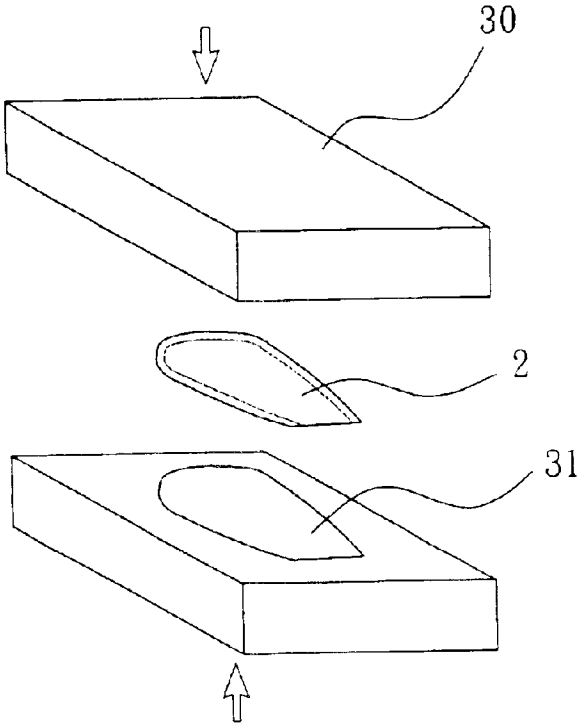
FIG. 4 is a schematic view of a pair of dies for stamping out a striking plate using the inventive method.

Referring to FIGS. 3 and 4, a method in accordance with the present invention for manufacturing a striking plate 20 of a golf club head includes a first step of soft heat-treating a flat metal blank 2 at a high temperature to increase its malleability. The blank 2 is cut out from a plate of an alloy, preferably of a high-strength stainless steel, and more preferably of a high-strength, precipitation hardening stainless steel, for example, of the grade SUS15-7.

The steel of the grade SUS15-7 is stainless steel of which the hardness varies depending on the heat treatment it is subjected to. That is, it can be soft heat-treated at a high temperature to be softened enough for subsequent processes of cutting, stamping or mechanical working and, after these processes, can be aged to be precipitation hardened again so as to recover or even increase its mechanical properties and elastic resilience.

The flat metal blank 2, cut out from the plate of stainless steel SUS15-7, can be soft heat-treated in a furnace by heating it to a high temperature in the range of 1050–1300 degrees Centigrade and maintaining it at the temperature for 30–360 minutes before cooling outside the furnace. The softened blank 2 is then tested to confirm that it has a reduced hardness between 10 HRC and 20 HRC.

Figure 5:
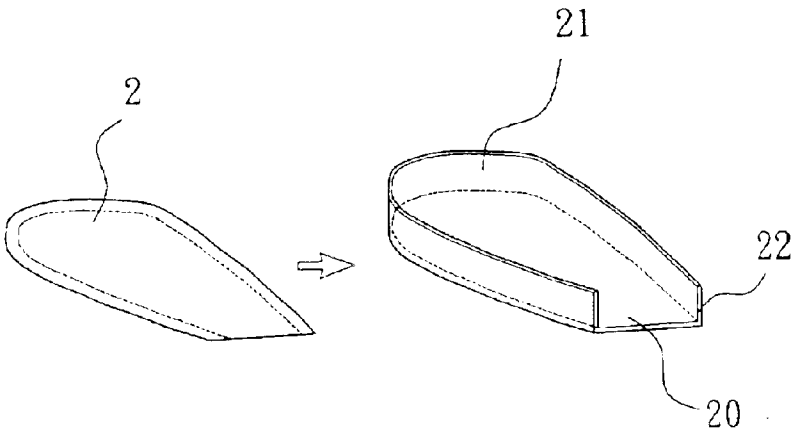
FIG. 5 is schematic view showing a striking plate with an integral wall is stamped out from a flat metal blank.

Referring to FIGS. 3 to 5, the inventive method includes a second step of stamping out a striking plate 20 with an integral wall 21 and a bend portion 22 from the blank 2. As soon as the blank 2 is softened, it is placed between a male die 30 and a female die 31 and stamped in shape either at a normal temperature as cold forming operation or at a high temperature as hot forming operation.

As a result of the stamping process, the striking plate 20 now has a fibered microstructure in its bent portion 22, which has better mechanical properties and elastic resilience than those of striking plates made by precision casting. Again, the bent portion 22 can also impede the transmitting of impact produced by the golf ball, so that the elastic resilience is maximized and a much higher coefficient of restitution is obtained. Therefore, the resulting striking plate 20 is applicable to a golf club known as wood, which is used for hitting the golf boll long distance.

Figure 6:
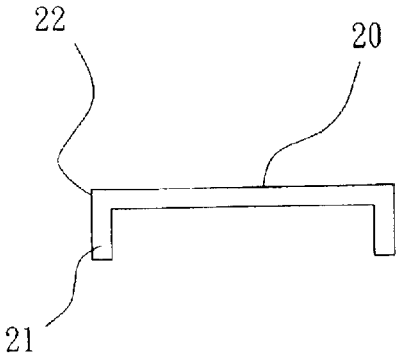
FIG. 6 is a cross-sectional view of a first possible embodiment of the striking plated manufactured using the inventive method.
Figure 7:
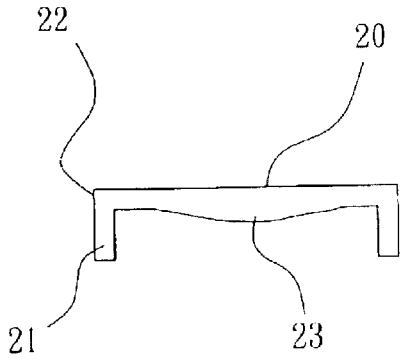
FIG. 7 is a cross-sectional view of a second possible embodiment of the striking plated manufactured using the inventive method.
Figure 8:
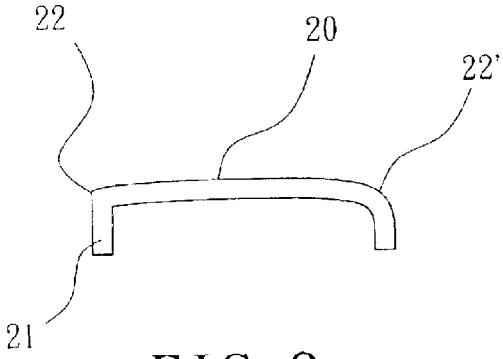
FIG. 8 is a cross-sectional view of a third possible embodiment of the striking plated manufactured using the inventive method.
Figure 9:
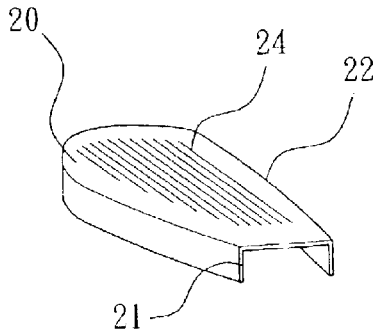
FIG. 9 is a perspective view of a fourth embodiment of the striking plate manufactured using the inventive method.

Referring to FIGS. 6 to 9, four preferred embodiments of the resulting striking plate 20 are shown. In fact, the shape of the striking plate 20 varies depending on the dies 30 and 31 in design choice. For example, the striking plate 20 may be stamped out so as to form a bent portion 22 at a right angle, as shown in FIG. 6, or to form variation in thickness, e.g. a thickened area 23 at its center or so called sweet spot, as shown in FIG. 7. It may also be stamped out so as to form variation in curvature, such as a rounded angle at its bent portion 22', as shown in FIG. 8, or to form additional grooves 24 or marks in the form of characters, symbols, patterns or trademarks impressed on the obverse.

Referring to FIG. 3, the inventive method optically includes a third step of precise machining the striking plate 20, such as by cutting, grinding, chamfering and/or burnishing to remove burrs on its rough edge. Importantly, the edges of the wall 21 must be ground so that they may be snugly engaged with a main body 10 of the golf club head, as illustrated in FIG. 2, for a subsequent welding process.

Figure 1:
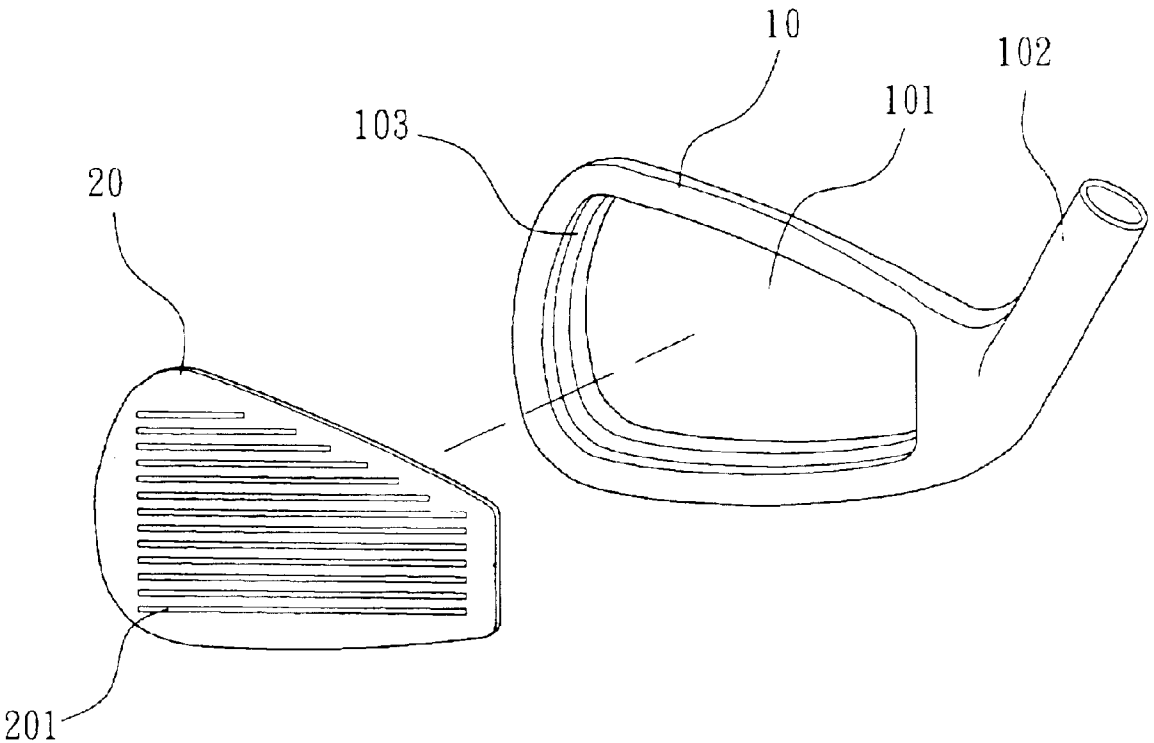
FIG. 1 PRIOR ART
FIG. 1 an exploded perspective view of a typical golf club head in prior art.
Figure 2:
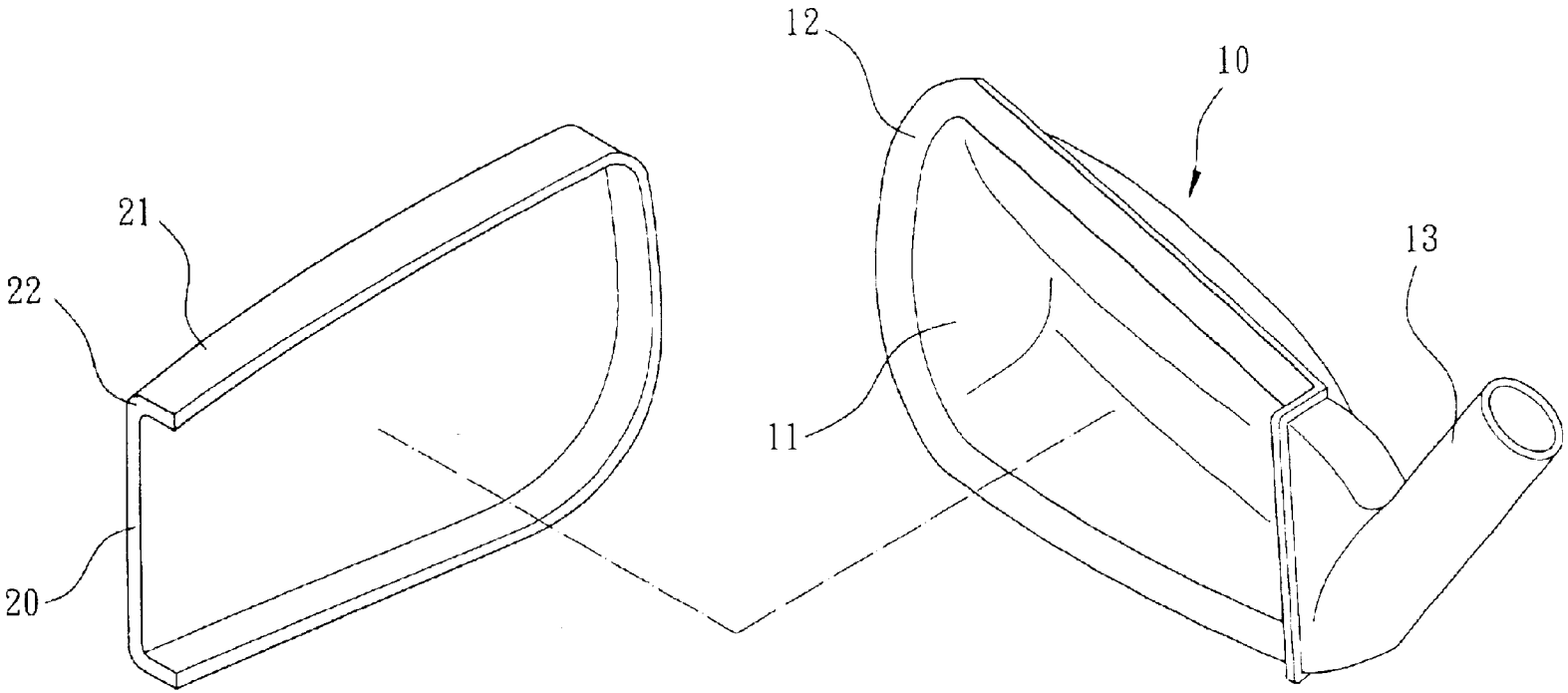
FIG. 2 PRIOR ART
FIG. 2 is an exploded perspective view of a golf club head including a striking plate that is made either by casting in accordance with the prior art or using the method in accordance with the present invention.

Referring to FIGS. 2 and 3, the inventive method further includes a fourth step of age hardening the striking plate 20 to precipitation harden it and increase its mechanical properties, after the striking plate 20 has been joined to the main body 10 to form a head to be used in a golf club known either as "iron" or as "wood". As shown in FIG. 2, the striking plate 20 is joined to the main body 10 preferably by welding the wall 21 to the main body 10 at its rim 12.

Based on the fact that the material has been softened during the process of soft heat-treating and that the welding normally results in a heat affected zone, in which residual stress is left, the age hardening process is indeed necessary to precipitation harden the joined striking plate 20 of the precipitation hardening stainless steel, in order to recover and even improve its mechanical properties, elastic resilience and weldability, which is much important if the striking plate 20 is welded to a main body 10 of a metal material different from the plate 20.

In a highly preferred embodiment, the age hardening is conducted artificially by tempering the joined striking plate 20 at a high temperature in the range of about 30–600 degrees Centigrade and maintaining it at the same temperature for about 2 hours. This precipitation hardens the entire striking plate 20 and further strengthens the bend portion 22, which has already been hardened by its fibered microstructure.

Either before or after the artificial age hardening, the striking plate 20 together with the associated main body 10 may be aged naturally at room temperature. All these provide the resulting striking plate 20 with a desirable elastic resilience.

From the foregoing, it is apparent that the method in accordance with the present invention is mainly achieved by stamping out a striking plate 20 subsequent to a soft heat-treatment to increase malleability of the associated blank 2, followed by age hardening the plate 20 to precipitation harden it so as to so as to recover and even improve its mechanical properties, especially at the wall 21 and the bend portion 22. Therefore, the resulting striking plate 20 has a better strength and elastic resilience than prior art one made by precision casting, which normally has a wall 21 and a bent portion 22 both with a less acceptably strength than necessary.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A method for manufacturing a striking plate of a golf club head, comprising the steps of:

soft heat-treating a flat metal blank at a high temperature to increase malleability of said flat metal blank;

stamping out a striking plate with an integral wall and a bend portion from said flat metal blank;

age hardening said striking plate to precipitation harden it and increase its mechanical properties after said striking plate has been joined to a main body of said golf club head.

2. The method as claimed in claim 1 further including a step of precise machining said striking plate subsequent to said step of stamping.

3. The method as claimed in claim 1, wherein said flat metal blank is cut out from a plate of stainless steel.

4. The method as claimed in claim 3, wherein said stainless steel is a high-strength, precipitation hardening stainless steel.

5. The method as claimed in claim 1, wherein said soft heat-treating is conducted by heating said flat metal blank to a temperature in the range of 1050–1300 degrees Centigrade and maintaining it at said temperature for 30–360 minutes.

6. The method as claimed in claim 1, wherein said soft heat-treating is conducted so that said flat metal blank may has a reduced hardness between 10 HRC and 20 HRC.

7. The method as claimed in claim 1, wherein said stamping is conducted at a normal temperature as cold forming operation.

8. The method as claimed in claim 1, wherein said stamping is conducted at a high temperature as hot forming operation.

9. The method as claimed in claim 1, wherein said stamping is also conduct to form additional grooves, marks, or variations in thickness and curvatures in the striking plate in addition to said integral wall and said bent portion.

10. The method as claimed in claim 1, wherein said age hardening is conducted by tempering said striking plate at a high temperature in the range of 300–600 degrees Centigrade to precipitation harden it after said striking plate has been joined to said main body of said golf club head.

11. The method as claimed in claim 1, wherein said striking plate is joined to said main body to form a head used in a golf club known as iron.

12. The method as claimed in claim 1, wherein said striking plate is joined to said main body to form a head used in a golf club known as wood.

* * * * *